United States Patent [19]

Gentry

[11] Patent Number: 4,879,827

[45] Date of Patent: Nov. 14, 1989

[54] SINGLE SHOT FALLING BLOCK ACTION RIFLE

[76] Inventor: Roger Gentry, 5005 Coronet La., Arlington, Tex. 76017

[21] Appl. No.: 152,756

[22] Filed: Feb. 5, 1988

[51] Int. Cl.[4] ..... F41C 7/00

[52] U.S. Cl. ..... 42/23

[58] Field of Search ..... 42/23, 24

[56] References Cited

U.S. PATENT DOCUMENTS

| | | | |
|---|---|---|---|
| 511,633 | 12/1893 | Mason | 42/23 |
| 794,770 | 7/1905 | Barning | 42/23 |
| 3,355,833 | 12/1967 | Ruger et al. | 42/23 |
| 3,382,597 | 5/1968 | Ruger et al. | 42/23 |
| 3,710,493 | 1/1973 | Gramiger et al. | 42/23 |
| 3,733,729 | 5/1973 | Baker | 42/23 |
| 4,040,196 | 8/1977 | Smith et al. | 42/23 |
| 4,128,956 | 12/1978 | Foote | 42/23 |
| 4,570,369 | 2/1986 | Gerfen | 42/23 |
| 4,648,190 | 3/1987 | Allen | 42/23 |

*Primary Examiner*—Deborah L. Kyle
*Assistant Examiner*—J. Woodrow Eldred
*Attorney, Agent, or Firm*—Charles D. Gunter, Jr.

[57] ABSTRACT

A single shot, falling block rifle is shown having a one-piece stock. The rifle includes a barrel having opposing ends with a receiver mounted on one end of the barrel. The receiver has a rearward face which includes an arch-shaped opening. A breechblock of lesser width than the receiver slides upwardly and downwardly within the arch-shaped opening allowing the size and weight of the action to be reduced. The action also includes a positive sear lock safety and a spring loaded striker which is manually cocked by means of the cooperative action of an operating lever, connecting link and cocking lever.

8 Claims, 5 Drawing Sheets

SINGLE SHOT FALLING BLOCK ACTION RIFLE

BACKGROUND OF THE INVENTION

1. Field of the Invention

The present invention relates to breechblock rifles and, specifically, to a lever-cocked single shot falling block rifle.

2. Description of the Prior Art

A variety of breechblock rifles are known in the prior art and are characterized according to the different type of action. The specific type of action is determined by the type of movement imparted to the breechblock as the breechblock moves into and out of engagement with the cartridge chamber of the receiver. Typical known actions include the swinging block action, the rolling block action and the falling block action.

A particularly well known falling block design is the Ruger No. 1 Falling Block Action which comprises a lever actuated single shot mechanism having a breechblock contained, spring biased firing pin mechanism. The Ruger No. 1 design is described in U.S. Pat. No. 3,355,833. A description of other falling block actions can be found in the book "Single Shot Rifles and Actions", by F. deHass (1969).

It is an object of the present invention to provide a single shot falling block rifle having an action which is extremely simple and reliable in nature.

Another object of the invention is to provide a falling block action rifle having an accuracy approaching or equalling that of a bolt action rifle.

Another object of the invention is the provision of a falling block rifle with a novel rifle action of suitable dimension to allow the action to be incorporated within a single-piece stock without detracting from the existing lines and aesthetic appearance of the single piece stock.

SUMMARY OF THE INVENTION

The falling block rifle of the invention has an improved action which is simple in design and economical to manufacture and which exhibits aesthetically pleasing lines while accommodating a broad range of calibers. The action can be provided of appropriate dimensions to allow the action to be contained within an opening provided in a single-piece stock without detracting from or radically altering the lines or dimensions of the stock and thus preserving the aesthetic appearance of the stock.

The single shot rifle includes a barrel having opposing ends. A receiver is mounted on one end of the barrel, the receiver having a forward face which joins the barrel and a rearward face separated by opposing sides which define a length, a width and an interior of the receiver. The rearward face forms an arch-shaped opening into the interior. The action includes a breechblock which has a leading portion of lesser relative width than that of the receiver which extends within the interior of the receiver and which is slidably engaged within the arch-shaped opening of the receiver. The breechblock has a trailing portion which extends outwardly from the arch-shaped opening of the receiver, whereby the breechblock is allowed upward and downward movement within the arch-shaped opening. A one-piece stock contains the breechblock, barrel and receiver. An operating lever moves the breechblock upwardly and downwardly with respect to the receiver.

Preferably, the trailing portion of the breechblock is also of lesser relative width than the receiver and of lesser relative width than the leading portion, the juncture of the leading and trailing portions defining a locking shoulder on the exterior of the breechblock. The arch-shaped opening of the receiver includes a lip region which extends along the periphery of the opening, thereby defining a retaining ledge within the receiver interior adjacent the arch-shaped opening. The breechblock locking shoulder contacts the retaining ledge 45 of the receiver as the breechblock moves upwardly and downwardly within the arch-shaped opening of the receiver. The locking shoulder also contacts the retaining ledge within the receiver interior to form a recoil surface when the rifle is fired.

A striker is mounted in the breechblock in line with the cartridge chamber when the breechblock is moved by the operating lever upwardly to the firing position. A striker block is movable between a lock position in which motion of the striker is prevented and a free position in which the striker is allowed to strike the cartridge. Biasing means normally urge the striker block downwardly, away from the striker. A trigger is pivotally mounted within the breechblock for movement between a cocked position and a firing position. A sear is pivotally mounted within the breechblock for movement into contact with the striker block to hold the striker block in the locked position when the trigger is in the cocked position and for releasing the striker block when the trigger is moved to the firing position. A safety is slidably mounted on the breechblock for vertical movement in a plane parallel to a rear wall of the breechblock between a safety position in which the safety positively engages the sear in the locked position and a ready position. The safety has an upper extent which protrudes above the breechblock when the safety is in the safety position and a lower extent which extends below the breechblock in the ready position. The upper extent provides not only means to position the safety to "off" safe, but also acts as a cartridge stop to prevent a live cartridge from being fully ejected from the action (when the safety is in on position).

The operating lever is pivotally connected to the receiver and to the breechblock via a connecting link for moving the breechblock upwardly and downwardly within the receiver. A cocking lever is pivotally mounted within the breechblock for cocking the striker, wherein movement of the operating lever causes a cam surface on the connecting link to contact the cocking lever to move the cocking lever and cock the striker. An ejector is pivotally mounted within the operating lever and pinned within the receiver. A pre-extraction lever is pivotally mounted within the receiver and is contactable by a cam surface provided on the cocking lever with movement of the cocking lever serving to actuate the pre-extraction lever, and, in turn, the ejector to initially move a cartridge from the chamber.

Additional objects, features and advantages will be apparent in the written description which follows.

BRIEF DESCRIPTION OF THE DRAWINGS

FIG. 2 is a side view of the falling block action of the rifle, partially in section with the rifle cocked and the safety on.

DETAILED DESCRIPTION OF THE INVENTION

Figure 1:
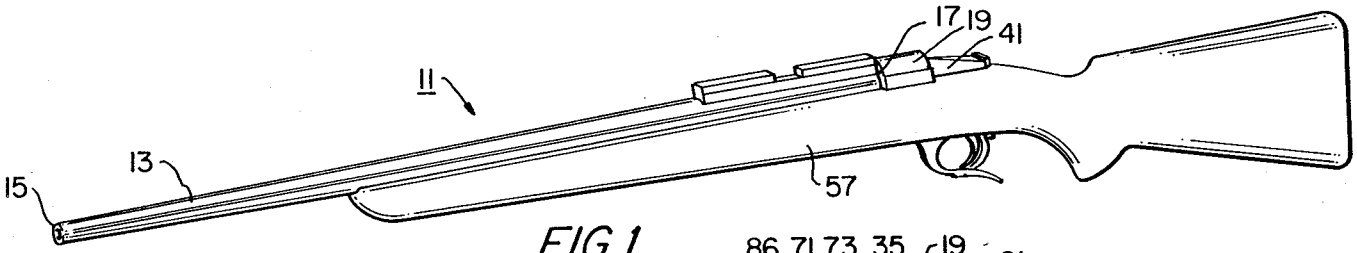
FIG. 1 is a perspective view of a single shot rifle of the invention.
Figure 6:
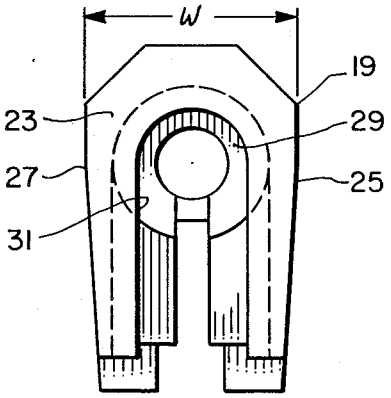
FIG. 6 is an isolated, end view of the receiver of the invention showing the retaining ledge in dotted lines.

FIG. 1 shows a single shot rifle of the invention designated generally 11. The rifle 11 includes a barrel 13 having opposing ends 15, 17. A receiver 19 is mounted on the end 17 of the barrel 13. The receiver 19 (FIG. 2) has a forward face 21 which joins the barrel 13 and a rearward face 23 separated by opposing sides (25, 27 in FIG. 6) which define a length ("1" in FIG. 7), a width ("w" in FIG. 6) and an interior 29 of the receiver. The rearward face 23 forms an arch-shaped opening 31 into the interior 29. A portion of the interior 29 of receiver 19 comprises a threaded bore 33 for matingly engaging the external threads 35 of the barrel 13. The barrel 13 also includes a cartridge chamber 37 for receiving a cartridge 39.

Figure 2:
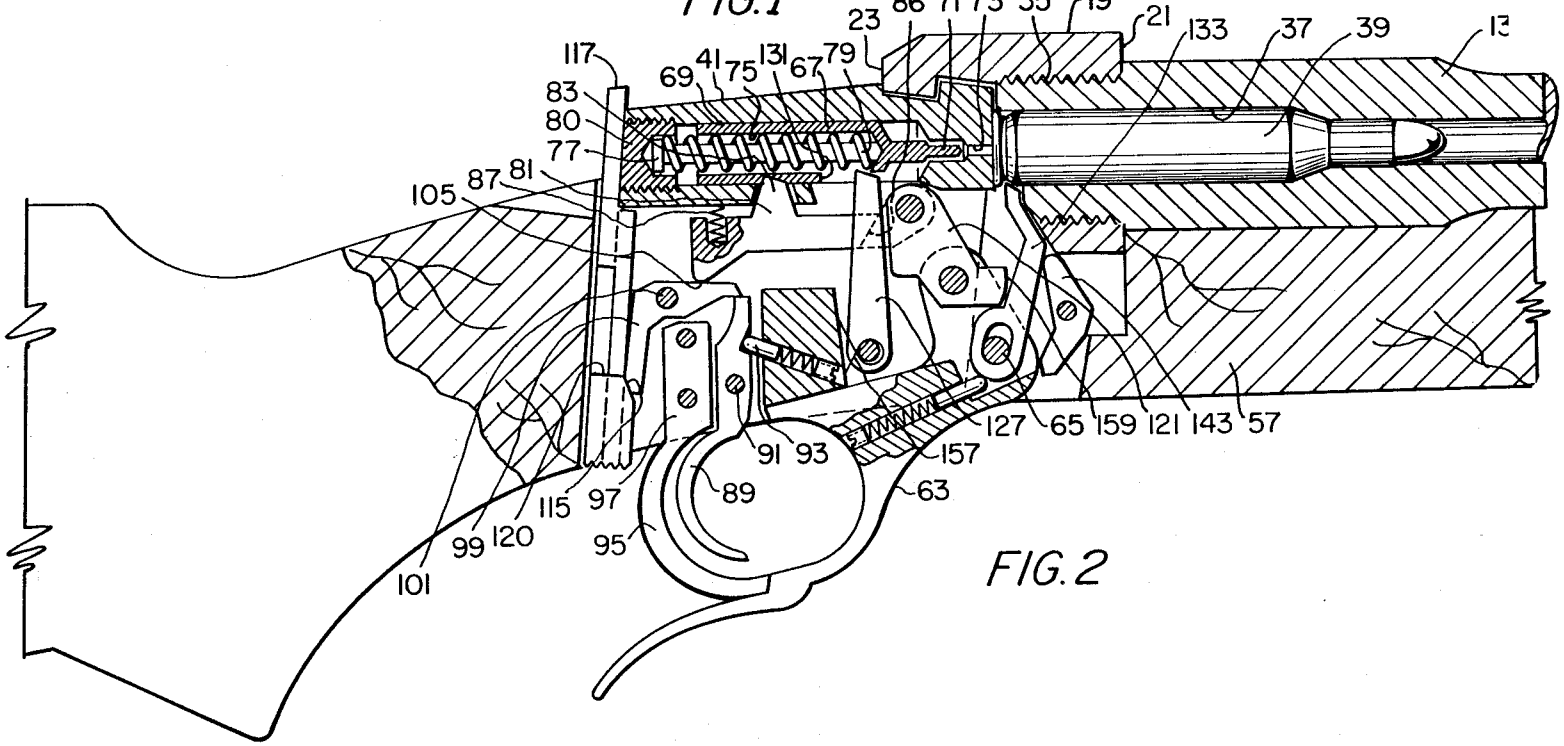
Figure 7:
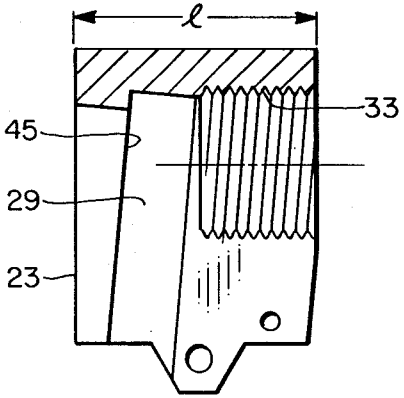
FIG. 7 is an isolated view of the receiver from the side and in cross-section.

A breechblock (41 in FIG. 9) having a leading portion 43 of lesser relative width than that of the receiver 19 extends within the interior 29 of the receiver (see FIG. 2). The breechblock leading portion 43 includes a mating region which is slidably engaged within the arch-shaped opening 31 of the receiver 19. Preferably, the arch-shaped opening 31 includes a lip region (45 in FIG. 7) which extends along the periphery of the opening 31, thereby defining a retaining ledge within the receiver interior 29 adjacent the arch-shaped opening 31. The breechblock 41 also includes an integral trailing portion 55 which extends outwardly beyond the arch-shaped opening 31 of the receiver. Preferably, the trailing portion 55 of the breechblock 41 is also of lesser relative width than the receiver and of lesser relative width than the leading portion, the juncture of the leading and trailing portions defining a locking shoulder 51 on the exterior of the breechblock. The breechblock locking shoulder 51 contacts the retaining ledge 45 of the receiver as the breechblock moves upwardly and downwardly within the arch-shaped opening 31. The locking shoulder 51 of the breechblock also contacts the retaining ledge 45 within the receiver interior to form a recoil surface when the rifle is fired. As shown in FIG. 7, the retaining ledge 45 forms an angle alpha of approximately 5° with respect to the plane of the rearward face 23, whereby the breechblock 41 moves on an angle of 5° off perpendicular. As a result, when the breechblock begins lowering, it will immediately begin moving away from the cartridge base. Because the breechblock moves slightly rearward as it starts down, any possibility of binding due to an expanded cartridge is eliminated.

Figure 8:
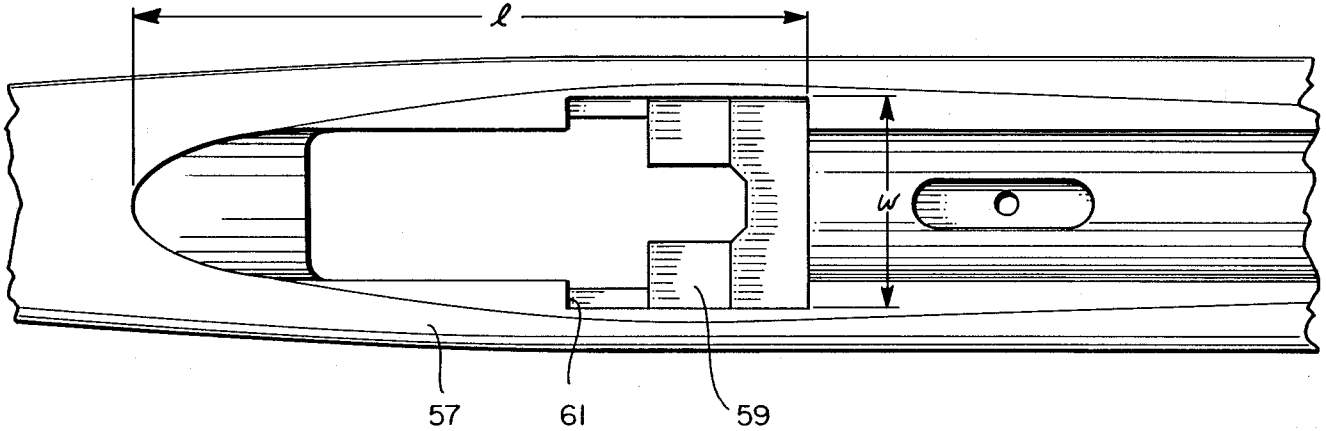
FIG. 8 is a top, partial view of the one-piece stock showing the stock opening.

As shown in FIGS. 1 and 2, the rifle includes a one-piece stock 57 for mounting the barrel 13, receiver 19 and breechblock 41. The one-piece stock 57 has an opening (59 in FIG. 8) which contains the receiver and the breechblock. The width "w" of the stock opening 59 decreases along a portion of the length "1" thereof to define an internal shoulder 61 within the stock opening 59. The rearward face (23 in FIG. 6) of the receiver 19 engages the internal shoulder 61 within the stock opening 59, whereby the internal shoulder comprises a recoil surface for the receiver within the stock.

As shown in FIG. 2, an operating lever 63 is provided for moving the breechblock 41 upwardly and downwardly with respect to the receiver 19. The operating lever 63 is mounted at a pivot point 65 within the receiver 19. A striker 67 is mounted in the breechblock 41 parallel to the cartridge chamber 37 for alignment with the chamber 37 when the breechblock is moved to the upward, firing position by the operating lever as shown in FIG. 2. The striker 67 includes a tubular extent 69 which decreases in external diameter in the direction of the cartridge chamber and terminates in a projecting pin 71 which is aligned within an opening 73 provided in the breechblock 41 for striking the cartridge base to fire the cartridge. The striker 67 has an open interior 75 into which is positioned a coil spring 79 and a spring guide 77. A threaded striker plug 80 retains the striker, spring and spring guide within a bore 82 provided in the breechblock 41 (see FIG. 9). The striker 67 is thus spring biased in the direction of the cartridge chamber 37 by means of coil spring 79 acting against the striker plug 80.

Figures 3, 4:
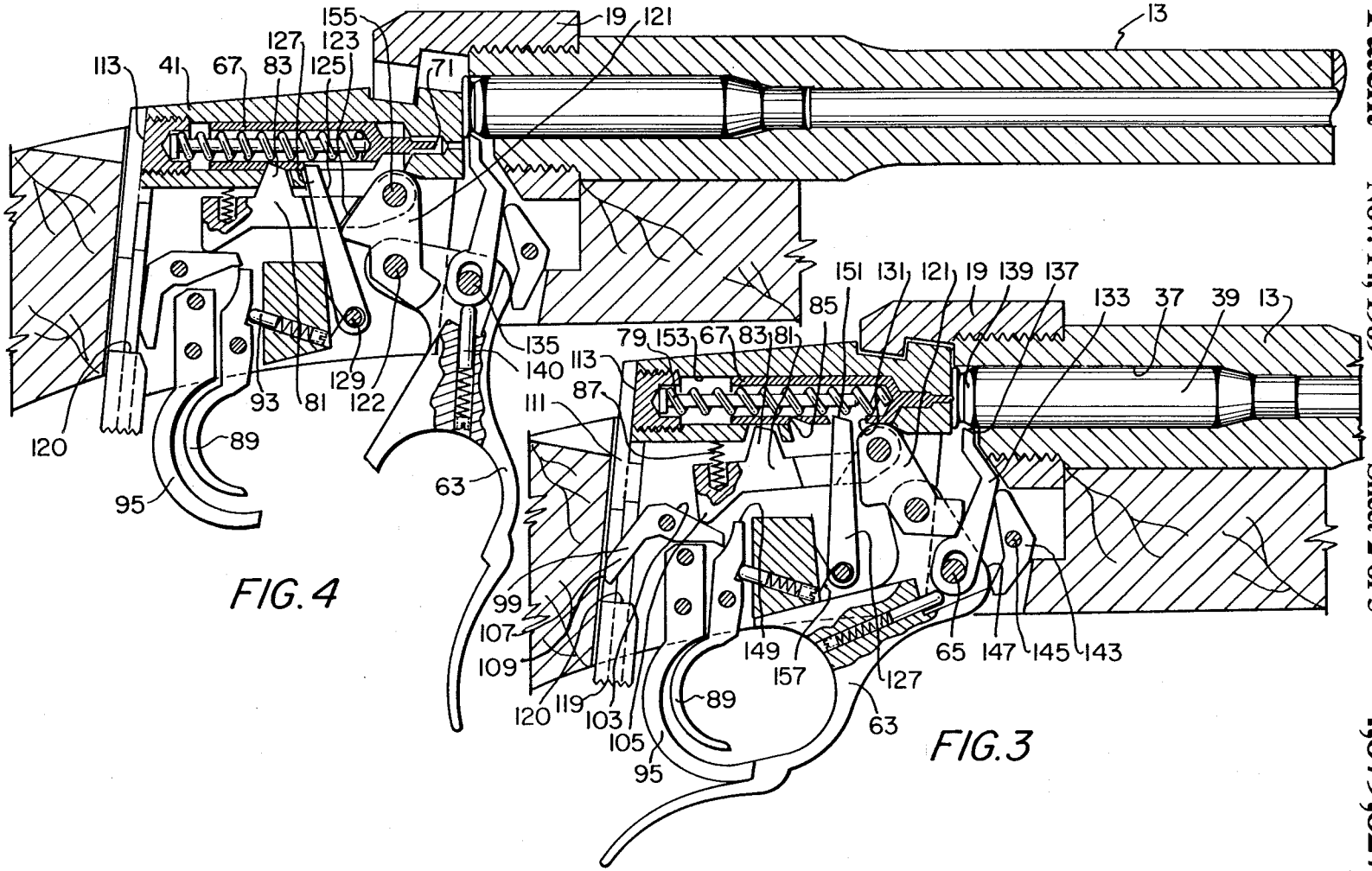
FIG. 3 is a view similar to FIG. 2 with the safety off and the rifle having been fired.
FIG. 4 is a view similar to FIG. 3 showing the initial cocking action of the rifle with the ejector contacting the cartridge lip.
Figure 9:
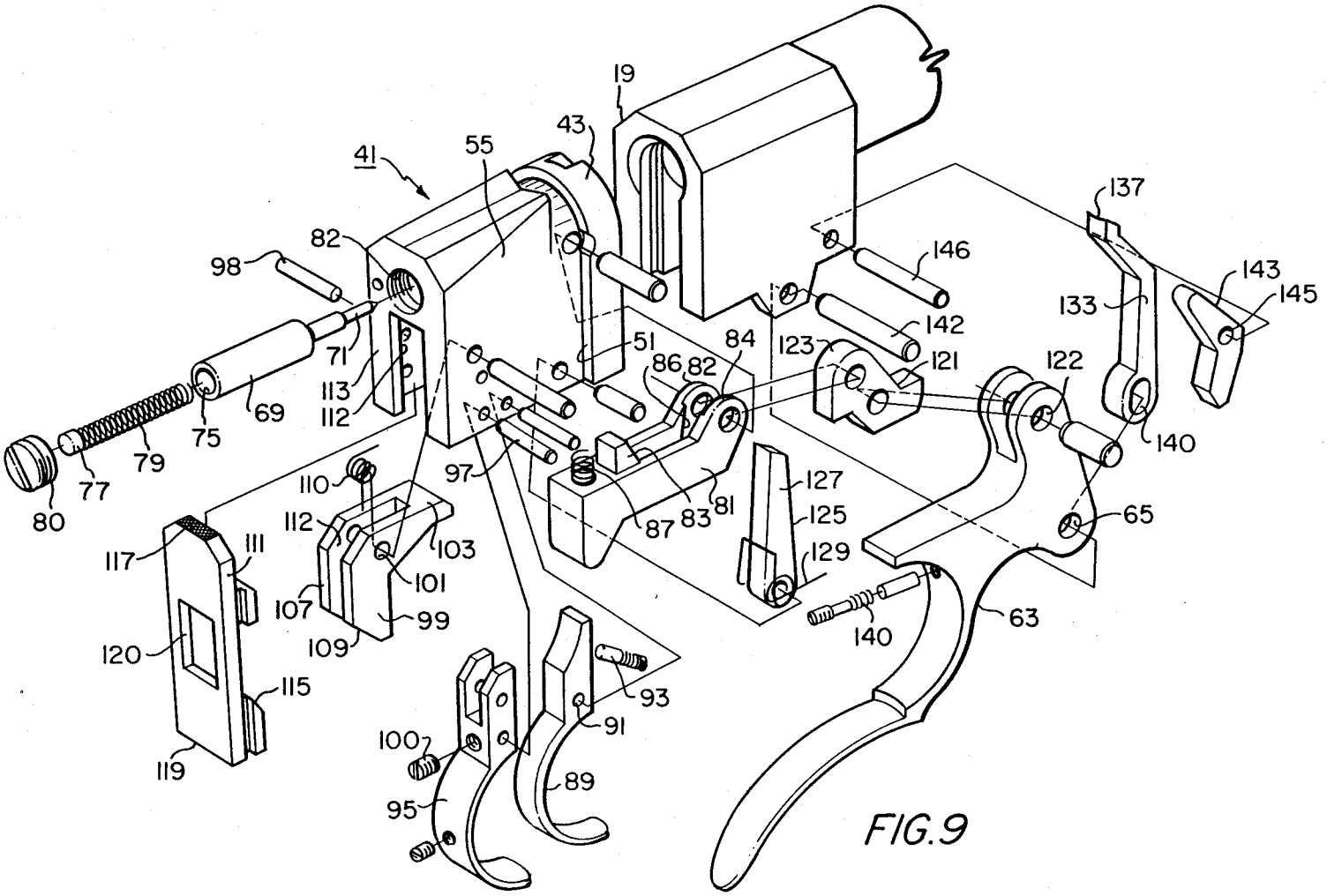
FIG. 9 is an exploded view of the rifle action.

A striker block 81 is mounted in the breechblock 41 and includes an upwardly directed flange 83 which is pivotable into engagement with a detent surface 85 (FIG. 3) provided in the striker 67 to control the movement of the striker 67 between a locked position as shown in FIG. 2 in which motion of the striker is prevented and a free position as shown in FIG. 3 in which the striker is allowed to strike the cartridge. Biasing means, such as coil spring 87, normally urge the striker block 81 downwardly, away from the striker 67. The striker block 81 also has a forward extent which forms a yoke having sides 82, 84 (FIG. 9). The inner walls of the yoke include beveled shoulders 86.

A trigger 89 is pivotally mounted within the breechblock 41 at a pivot point 91 for movement between a cocked position, as shown in FIG. 2, and a firing position as shown in FIG. 3. The trigger is normally biased toward the cocked position, shown in FIG. 2, by means of a spring loaded plunger 93 contained in a bore provided in the breechblock 41. A rear trigger guard 95 is mounted within the breechblock 41 by pins 97, 98. Set screw 100 can be used to adjust trigger pull.

A sear 99 is mounted within the breechblock 41 at a pivot point 101 for movement into contact with the striker block 81 to hold the striker block in the locked position (see FIG. 2) when the trigger is in the cocked position and for releasing the striker block (see FIG. 3) when the trigger is moved to the firing position.

The sear 99 is an L-shaped member having an upper surface 103 (see FIG. 3) for contacting the pivot end 105 of the striker block 81 and having a downwardly extending leg 107 with a lower tapered extent 109. A coil spring 110 is received within recess 112.

A safety 111 is slidably mounted on the breechblock 41 for vertical movement in a plane parallel to a rear wall 113 of the breechblock 41. The safety is an elongate member having a window opening 120. The safety 111 can be moved between a safety position, shown in FIG. 2, in which an internally tapered surface 115 engages the lower tapered extent 109 of the sear 99 in the locked position and a ready position (see FIG. 3). In the ready position, the sear downwardly extending leg 107 is free to swing within the window opening 120. The safety 111 has an upper extent 117 (FIG. 2) which protrudes above the breechblock 41 when the safety is in the safe position. A lower extent 119 (FIG. 3) extends below the breechblock 41 in the ready position.

Figure 5:
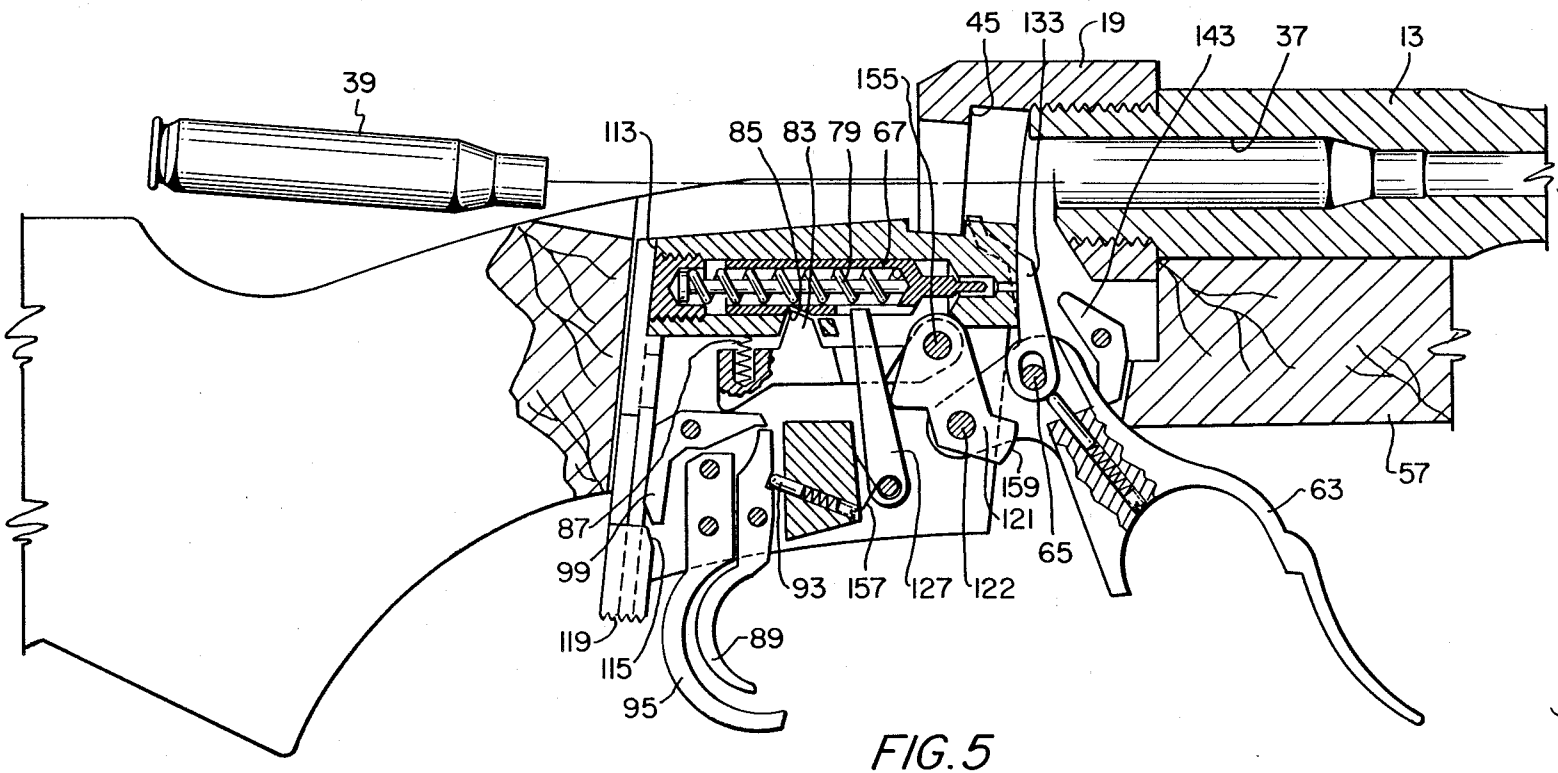
FIG. 5 is a view similar to FIG. 4 showing the operating lever completely extended to eject the spent cartridge case.

As shown in FIG. 2, the operating lever 63 is connected to a connecting link 121 at a pivot point 122. The connecting link 121 is, in turn, connected to breechblock 41 at pivot point 155, facilitating the lowering and raising of breechblock 41 by movement of operating lever 63. The connecting link 121 includes a cam surface 123 (FIG. 4) which is adapted to contact a rear face 125 of a cocking lever 127. The cocking lever 127 is an elongate member which is mounted at a pivot point 129 in the breechblock 41 at one extent and has an opposite extent which protrudes through a window opening 131 (FIG. 2) provided in the striker 67. As shown in FIGS. 3–5, movement of the operating lever 63 causes the cam surface 123 of the connecting link 121 to move the cocking lever 127 rearward in a direction away from the cartridge chamber 37 and cock the striker 67. As the striker 67 moves to the cocked position, the upwardly directed flange 83 of the striker block 81 engages the detent surface 85 (see FIG. 3) to retain the striker in the cocked position. The operating lever 63 can then be returned to the position shown in FIG. 2.

As shown in FIG. 3, the firing mechanism also includes an ejector 133 which is mounted within a yoke opening on the operating lever 63 at pivot point 65. The ejector 133 is a dog-leg shaped member having an upper end 137 for contacting a lip region 139 of a spent cartridge 39. The ejector 133 has an enlarged opening 140 (FIG. 9) for receiving mounting pin 142.

A pre-extraction lever 143 is mounted at a pivot point 145 by a pin 146 within the receiver 19 and is contactable by a cam surface 147 provided on the cocking lever 63, movement of the cocking lever serving to actuate the pre-extraction lever 143 and, in turn, the ejector 133 to initiate cartridge ejection from the chamber (see FIGS. 3–5).

The operation of the rifle will now be described with reference to FIGS. 2–5. FIG. 2 shows the rifle with a cartridge 39 in the chamber 37, the striker 67 being in the cocked position and the sear 99 holding the striker block 81 in the locked position. The tapered surface 115 of the safety engages the mating surface 109 of the sear. In FIG. 3, the safety upper extent 117 has been pushed downwardly to free the sear 99. The trigger has also been pulled moving its upper extent 149 from beneath the sear, thereby allowing downward movement of the striker block 81. Because the striker block 81 is spring loaded downwardly by coil spring 87, a light weight striker 67 utilizing a small coil spring 79 can be utilized. In certain of the prior designs, the striker block is spring loaded upwardly, requiring the striker spring to overcome the striker block during firing, thus losing impact energy.

As the striker block moves out of engagement with the detent surface 85, the striker 67 is propelled forward by the force of the spring 79 so that the pin 71 contacts the cartridge 39. FIG. 3 shows the gun in the fired position.

In addition to being spring biased downwardly, the striker block 81 of the present design is manually cocked through the combined effort of the operating lever 63, connecting link 121. As the operating lever is moved away from the trigger guard 95, the cam surface 123 of the connecting link 121 moves the cocking lever 127 toward the rear wall 113 of the breech block. The upper extent 151 of the cocking lever 127 forces the striker 67 rearwardly within the striker chamber 153 to the position shown in FIG. 4.

As the operating lever 63 begins to move from the position shown in FIG. 3, the cam surface 147 contacts the pre-extraction lever 143 which, in turn, contacts the ejector 133 causing the upper end 137 to contact the cartridge lip 139. A spring loaded plunger 140 in the operating lever 63 forces the ejector 133 in the upward direction, the ejector being allowed some vertical play at the enlarged opening 140. As the operating lever moves to the position shown in FIG. 4, the operating lever 63 is pivoted about pivot point 65 in the receiver and the connecting link 121 is pivoted about pivot points 122 and 155 so that the breechblock 41 moves downwardly within the receiver 19. During the pivot of connecting link 121, the cam surface 123 on connecting link 121 engages internal shoulders 86 on striker block 81, raising striker block flange 83 into engagement with striker 67. Once the striker detent surface 85 is engaged by the striker block flange 83, the spring loaded plunger 93 returns the trigger and sear to the original position shown in FIG. 4. As the operating lever 63 moves to the fully open position shown in FIG. 5, the ejector 133 forces the spent cartridge 39 outwardly from the cartridge chamber 37. The operating lever 63 can then be returned to the position shown in FIGS. 2 and 3. The cocking lever 127 is spring loaded by means of spring 157 to return to the forward position shown in FIG. 2 once the operating lever 63 is returned to the closed position. As a result, the cocking lever 127 is not carried forward by the striker 67 during firing, effectively eliminating its mass moving with the striker.

The various parts of the rifle design which have been described provide a novel rifle action with unique advantages over the existing art. For instance, the connecting link 121 serves several important functions in applicant's design. First, it pivotally links the breechblock 41 to the operating lever 63 to raise and lower the breechblock. Secondly, it partially retracts the striker 67 by camming the cocking lever 127 before any downward motion of the breechblock to insure that the striker pin 71 is withdrawn within the opening 73. Thirdly, the connecting link 121 fully retracts the striker 67 to a cocked position by camming the cocking lever 127. Fourthly, it raises the striker block 81 into the cocked position and engages the striker. Fifthly, it functions as a locking lever when the operating lever is fully closed. Sixthly, the cam surface 159 on the connecting link serves to fully position the ejector 133 to its forward position when the operating lever is fully closed.

The operating lever of applicant's design works with the other components of the action to serve at least seven major functions: (1) it raises and lowers the breechblock; (2) it recocks the striker in conjunction with the connecting link and cocking lever; (3) it pivots the ejector at the proper moment to eject the cartridge case; (4) it serves as the front portion of the trigger guard; (5) it acts as a cover for the bottom of the breechblock against dirt and debris when in the closed position; (6) it provides a housing for the ejector spring and plunger; and (7) it cams the preextraction lever prior to pivoting the ejector.

In addition to its unique operation, an additional advantage of applicant's design is the provision of an action which is compact enough to be received within an opening in a traditional style, one piece stock. A one piece stock contributes greatly to accuracy of the rifle and eliminates the tendency toward vertical impact shift inherent in the two piece stocks utilized in the prior art designs. Because the trailing portion of the breechblock 41 extends out of, rather than being surrounded by, the receiver walls, a drastic reduction in mass and surface area of the firing mechanism is allowed. This reduction in mass and surface area is accomplished without a loss of recoil surface or locking strength in the action due to the arch-shaped opening 31 and lip region 45 of the receiver and the mating breechblock. The arch-shaped opening 31 provides a structural locking surface equivalent of that to a bolt-action rifle and prevents the side walls of the opening from spreading by virtue of the connecting property of the arch. The arch also provides an upper stop for the breechblock 41 which allows a past dead-center looking action by the corresponding locations of the connecting link 121 and operating lever 63. This also facilitates the relocation of the breechblock 41 in its position in the receiver to the same position each time the breechblock is raised and lowered. The receiver lip 45 and past dead-center locking action also serve to lock the operating lever 63 into its closed position with no other mechanical locking devices.

Because the width of the trailing portion 55 of the breechblock 41 is less than the width of the receiver 19, the rearward face 23 of the receiver can be utilized as a recoil surface within the stock. This design provides a greater recoil surface area than in bolt-action designs in which a stop plug is traditionally utilized. The design also adds the balance of having recoil surfaces on either side of the receiver and cartridge chamber and by positioning the recoil surfaces nearer to the center line of the bore.

The vertically sliding safety 111 completely blocks the sear 99 in the safety position, thereby providing a positive safety. The safety is totally ambidextrous and does not require interchange depending upon any particular shooter. The design is simple and quick to operate. Because the safety protrudes from the top and bottom of the breechblock, its position relative to safe or fire, is readily detected by the user.

Because of the arrangement of the cocking lever 127, connecting link 121 and operating lever 63, opening or closing of the operating lever 63 serves to cock the striker. Thus, if the trigger is accidentally pulled while the breechblock is open, the action is again cocked upon closing the operating lever.

The one-piece stock and firing mechanism provide a falling block action with accuracy comparable to that of a bolt action design while preserving the aesthetic appearance of the firearm.

Applicant's rifle action also exhibits superior firing characteristics which can be expressed best in terms of the "lock time" of the action. As explained in the book "The Bolt Action", Stuart Otteson, Winchester Press, page 245, the total elapsed time required to fire a cartridge, that which is attributable to the rifle and ammunition involves three distinct intervals: trigger actuation to sear release, sear release to striker impact, and striker impact to exit of the bullet from the muzzle. The first two are combined under the term "lock time" and the third is termed "action time" Lock time in a bolt action typically runs between about 2–9 milliseconds. For non-straight line systems such as found in levers, pumps and automatics, lock time can be even considerably greater. The lock time of the applicant's action has been calculated at 1.5 milliseconds in test firings which represents a substantial improvement over the existing actions.

The present action is extremely tidy and compact offering the capability of an exceptionally light weight rifle. The completed rifle is approximately six inches to eight inches shorter than a comparable bolt action rifle with the same length barrel. The receiver and breechblock are strong enough to withstand the pressure of commercially available high powered sporting cartridges.

While the invention has been shown in only one of its forms, it is not thus limited but is acceptable to various changes and modifications without departing from the spirit thereof.

What is claimed is:

1. A single shot rifle, comprising:

a barrel having opposing ends;

a receiver mounted on one end of the barrel, the receiver having a forward face which joins the barrel and a rearward face separated by opposing sides which define a length, a width and an interior of the receiver, the rearward face forming an arch-shaped opening into the interior;

a breechblock having a leading portion of lesser relative width than that of the receiver which extends within the interior of the receiver and which is slidably engaged within the arch-shaped opening of the receiver, the breechblock also having a trailing portion of lesser relative width than the receiver which extends outwardly from the arch-shaped opening of the receiver, whereby the breechblock is allowed upward and downward movement within the arch-shaped opening, the arch-shaped opening including a lip region which extends along the periphery of the opening, thereby defining an internal retaining ledge contained within the receiver interior adjacent the arch-shaped opening, the breechblock leading portion being provided with a mating region formed therein including a locking shoulder which contacts the retaining ledge within the receiver and breechblock as well as a recoil surface when the rifle is fired;

a stock containing the breechblock, barrel and the receiver; and means for moving the breechblock upwardly and downwardly with respect to the receiver.

2. A single shot rifle, comprising:

a barrel having opposing ends;

a receiver mounted on one end of the barrel, the receiver having a forward face which joins the barrel and a rearward face separated by opposing sides which define a length, a width and an interior of the receiver, the rearward face forming an arch-shaped opening into the interior;

a breechblock having a leading portion of lesser relative width than that of the receiver which extends within the interior of the receiver and which is slidable engaged within the arch-shaped opening of the receiver, the breechblock having a trailing portion of lesser relative width than the receiver which extends outwardly from the arch-shaped opening of the receiver, whereby the receiver terminates short of the breechblock trailing portion and the breechblock is allowed upward and downward movement within the arch-shaped opening with the trailing portion being unconfined by the receiver, the arch-shaped opening including a lip region which extends along the periphery of the opening, thereby defining a semi-circular internal retaining ledge contained within the receiver interior adjacent the arch-shaped opening, the breechblock leading portion being provided with a mating region formed therein including a locking shoulder which contacts the retaining ledge within the receiver interior to form a semi-circular locking lug region between the receiver and breechblock as well as a recoil surface when the rifle is fired;

a one-piece stock for mounting the barrel, receiver and breechblock, the one-piece stock having an opening which contains the receiver and the breechblock; and means for moving the breechblock upwardly and downwardly with respect to the receiver.

3. The single shot rifle of claim 2, wherein the width of the stock opening decreases along a portion of the length thereof to define an internal shoulder within the stock opening and wherein the rearward face of the receiver engages the internal shoulder within the stock opening whereby the internal shoulder comprises a recoil surface for the receiver within the stock.

4. A single shot rifle, comprising:

a barrel having opposing ends and a cartridge chamber therein for receiving a cartridge:

a receiver mounted on one end of the barrel adjacent the location of the cartridge, the receiver having a forward face which joins the barrel and a rearward face separated by opposing sides which define a length, a width and an interior of the receiver, the rearward face having an arch-shaped opening which includes a lip region which extends along the periphery of the opening, thereby defining a retaining ledge within the receiver interior adjacent the arch-shaped opening;

a breechblock having a leading portion of lesser relative width than that of the receiver which extends within the interior of the receiver and which is slidably received within the arch-shaped opening of the receiver, the breechblock having a trailing portion which extends outwardly from the arch-shaped opening of the receiver, whereby the breechblock is allowed upward and downward movement within the arch-shaped opening between a firing and a loading position;

a one-piece stock for mounting the barrel, receiver and breechblock, the one-piece stock having an opening which contains the receiver and the breechblock;

an operating lever for moving the breechblock upwardly and downwardly with respect to the receiver;

a striker mounted in the breechblock in line with the chamber when the breechblock is in the upward, firing position for striking a cartridge;

a striker block movable between a lock position in which motion of the striker is prevented and a free position in which the striker is allowed to strike the cartridge;

biasing means for normally urging the striker block downwardly, away from the striker;

a trigger pivotally mounted within the breechblock for movement between a cocked position and a firing position, and a sear pivotally mounted within the breechblock for movement into contact with the striker block to hold the striker block in the lock position when the trigger is in the cocked position and for releasing the striker block when the trigger is moved to the firing position; and a safety slidably mounted on the breechblock for vertical movement in a plane parallel to a rear wall of the breechblock between a safety position in which the safety positively engages the sear in the lock position and a ready position, the safety having an upper extent which protrudes above the breechblock when the safety is in the safety position and a lower extent which extends below the breechblock in the ready position.

5. The single shot rifle of claim 4, wherein the operating lever is pivotally connected to the receiver and to the breechblock via a connecting link for moving the breechblock upward and downward within the receiver, the connecting link having a cam surface thereon.

6. The single shot rifle of claim 5, further comprising:

a cocking lever pivotally mounted within the breechblock for cocking the striker; and wherein movement of the operating lever causes the cam surface of the connecting link to contact the cocking lever to move the cocking lever and cock the striker.

7. The single shot rifle of claim 6, wherein the movement of the operating lever also causes the cam surface of the connecting link to contact the striker block to move the striker block to the locked position.

8. The single shot rifle of claim 7, further comprising:

an ejector pivotally mounted within the receiver;

a pre-extraction lever pivotally mounted within the receiver and contactable by a cam surface provided on the cocking lever, movement of the cocking lever serving to actuate the pre-extraction lever and, in turn, the ejector to remove a cartridge from the chamber.

* * * * *